US005876461A

United States Patent [19]

Racette et al.

[11] Patent Number: 5,876,461

[45] Date of Patent: Mar. 2, 1999

[54] METHOD FOR REMOVING CONTAMINANTS FROM TEXTILES

[75] Inventors: Timothy L. Racette, Plainfield; James E. Schulte, Cicero; Manfred Wentz, Naperville, all of Ill.

[73] Assignee: R. R. Street & Co. Inc., Naperville, Ill.

[21] Appl. No.: 819,415

[22] Filed: Mar. 17, 1997

Related U.S. Application Data

[60] Provisional application No. 60/013,645, Mar. 18, 1996.

[51] Int. Cl.[6] ..... D06L 1/08

[52] U.S. Cl. ..... 8/137; 8/142; 510/285; 510/289; 510/290; 510/291; 134/26; 134/38

[58] Field of Search ..... 8/137, 142; 510/285, 510/289, 290, 291; 134/26, 38

[56] References Cited

U.S. PATENT DOCUMENTS

| | | | |
|---|---|---|---|
| 3,505,001 | 4/1970 | Wagner | 8/192 |
| 3,640,881 | 2/1972 | Moussalli | 510/287 |
| 3,657,173 | 4/1972 | Eanzel et al. . | |
| 3,782,898 | 1/1974 | Mandell . | |
| 4,023,927 | 5/1977 | Forschirm . | |
| 4,708,807 | 11/1987 | Kemerer . | |
| 5,613,984 | 3/1997 | Nightingale et al. | 8/142 |

FOREIGN PATENT DOCUMENTS 1940432 2/1971 Germany .

OTHER PUBLICATIONS

Chemical Abstracts, vol. 110, No. 24 Jun. 12, 1989, Yamada Kiyomi et al. "Dry Cleaning and Washing Fabrics", Abstracts No. 110:215 254 m.

*Primary Examiner*—Alan Diamond
*Attorney, Agent, or Firm*—Mayer, Brown & Platt

[57] ABSTRACT

Method includes the steps of (1) treating the textile with a predetermined amount of a non-durable sacrificial repellent material before putting the textile in service; (2) cleaning the textile with a mixture of a non-polar solvent and at least one cleaning additive to remove non-polar solvent soluble, insoluble and resistant contaminants from the textile; (3) washing the textile with a mixture of a polar solvent and at least one washing additive to remove polar solvent soluble contaminants from the textile; and (4) maintaining a predetermined amount of a non-durable sacrificial repellent material on the textile. The non-polar solvent may be perchloroethylene or the like, while the cleaning additive is a mixture of a dialkyl ketone, a carboxylic ester and a glycol ether. A second cleaning additive may be used to enhance contaminant removal. The polar solvent used is water, while the washing additive is a blend of surfactants. The repellent material used is either a fluorocarbon polymeric material or a hydrocarbon polymeric material, which is applied as necessary to maintain a predetermined amount of the non-durable sacrificial repellent material on the textile in the range of from about 0.5 to about 3.0% solids on fabric by weight. Drying steps are preferred after the non-polar solvent cleaning step so as to remove any residual non-polar solvents, and after the maintaining step so as to cure the non-durable sacrificial repellent material thereon.

19 Claims, 5 Drawing Sheets

METHOD FOR REMOVING CONTAMINANTS FROM TEXTILES

This application claims the benefit of U.S. Provisional Application No. 60/013,645 filed on Mar. 18, 1996.

BACKGROUND OF THE INVENTION

1. Field Of The Invention

The present invention relates to a method and system for treating textiles with a non-durable, sacrificial soil repellent or soil release material before being placed into service and a sequence of solvent treatments containing additives after textiles are soiled so as to remove complex contaminants therefrom, as well as to recondition such textiles for subsequent reuse. Particularly, the present invention includes treating contaminated textiles with a sequence of nonpolar and polar solvents containing additives for purposes of cleaning and reconditioning such textiles. Additives are required to enhance cleaning properties of the solvents for the removal of contaminants having various solubility characteristics. Additives may also be used to impart protective or other desirable characteristics to the textiles.

2. Description Of Related Art

Textiles are often exposed to and soiled by, either intentionally or unintentionally, a variety of contaminants and undesirable materials. For purpose of example, and not limitation, four categories of contaminants are generally recognized: (1) contaminants that are soluble in nonpolar solvents (e.g., perchloroethylene ("PERC" or "PCE") , other chlorinated solvents, or petroleum); (2) contaminants that are soluble in a polar solvent (e.g., water); (3) resistant contaminants that are insoluble in conventional nonpolar and polar solvents; and (4) completely insoluble contaminants.

It is typically desirable, if not required, to remove contaminants from the soiled textiles. A variety of methods and devices are known for cleaning textiles; these known methods generally use a single solvent to remove the contaminant from the textile. One such single solvent method is a commercial washing process, which uses water and one or more detergents. Although generally effective for the removal of common soils, such as perspiration and food stains, commercial washing processes often are not capable of removing resistant nonpolar contaminants such as paints, undercoatings, sealants, dyes and many chemical treatments without causing damage and premature failure of the textiles By contrast, dry cleaning processes using a single solvent and one or more selected additives may be safe to the fabric but only partially effective or ineffective in removing polar soluble and resistant nonpolar contaminants. These conventional dry cleaning processes, while more effective on resistant paint and coatings than polar solvents, do not achieve satisfactory results without labor intensive manual application (spotting) of certain strong solvents which may cause damage if improperly applied Consequently, the useful life of the textile is shortened significantly.

Limitations using any one of the conventional cleaning methods therefore arise when the textile to be cleaned is soiled with a complex combination of contaminants. For example, uniforms and clothing worn in industrial settings are often contaminated with unique liquid and particulate materials, as well as common soils, such as perspiration and food stains. Such complex contamination particularly occurs in industrial environments where resistant coatings or chemical treatments are being applied to an object surface, e.g., painting, etching and over-coating processes.

Carpeting, upholstery and fabrics that are present in such environments likewise may become soiled or contaminated if not properly covered. Protective covers used in the application processes also may become contaminated. Therefore, the protective tarps, drop cloths and sheets used to cover protected surfaces and the garments worn during the application process typically become soiled by exposure to the liquid and particulate materials and therefore need cleaning for continued use.

Because any one of the conventional single solvent cleaning methods are not capable of removing a variety of contamination categories, textiles soiled with complex contamination generally cannot be cleaned satisfactorily without risk of damage to the textile. Neither can any of the conventional single solvent cleaning methods be combined into a singular process because of incompatibility between known solvents and additives and the resultant solvent cross contamination The only other known alternative for removing such complex contamination is specialized manual removal prior to subjection to a conventional cleaning process, which is often impractical, uneconomical and potentially harmful to the textile. Residual contamination therefore accumulates after repeated use, such that the textile loses its original properties and becomes unsightly and if a garment, uncomfortable. Residual contamination due to incomplete cleaning also can interfere with certain industrial applications. It therefore becomes necessary to discard such contaminated textiles far before their expected service life, which results in increased costs.

In addition to removing contaminants, it is often desirable to recondition textiles to maintain or replace, to the extent possible, the original characteristics of the textile with respect to comfort, appearance, hygiene, and compatibility with the intended use. It further is desirable to treat textiles with repellent-type additives capable of preventing the penetration of and facilitating the removal of subsequent contamination. Conventional single solvent cleaning methods are not capable of achieving these goals.

Satisfactory removal of complex contamination from textiles requires a specialized method of treatment. Lacking the proper sequence of solvents and appropriate additives, conventional cleaning techniques are inadequate and may damage, alter, or altogether remove the desirable appearance and wear characteristics of the textile. Conventional single solvent cleaning methods generally are not capable of removing complex contamination. As such, there remains a need for a more effective method and system for treating textiles soiled with complex contamination.

SUMMARY OF THE INVENTION

The purpose and advantages of the invention will be set forth in and apparent from the description and drawings that follow, as well as will be learned by practice of the invention. Additional advantages of the invention will be realized and attained by the elements of the method particularly pointed out in the appended claims.

To achieve these and other advantages and in accordance with the invention, as embodied and broadly described herein, the invention includes a method for removing contamination from a textile. The term "contamination" as used herein is inclusive of contaminants that are soluble in a nonpolar solvent, contaminants that are soluble in a polar solvent, resistant contaminants that are insoluble in conventional polar and nonpolar solvents and completely insoluble contaminants, as well as combinations thereof. The term "textile" is inclusive of, but not limited to, woven or nonwoven materials, as well as articles therefrom. Although preferably used for removing complex combinations of contaminants from textiles, the method of the invention may be used for removing any of a wide range of contaminants therefrom and, therefore, generally is not limited by any particular category of contaminants.

In accordance with the invention, the method generally includes the steps of (1) treating the textile with a predetermined amount of a non-durable sacrificial repellent material before putting the textile in service; (2) cleaning the textile with a mixture of a non-polar solvent and at least one cleaning additive to remove nonpolar solvent soluble contaminants and insoluble contaminants from the textile; (3) washing the textile with a mixture of a polar solvent and at least one washing additive to remove polar solvent soluble contaminants from the textile; and (4) maintaining a predetermined amount of a repellent material on the textile.

The non-polar solvent used for the cleaning step preferably is a cleaning solvent such as perchloroethylene or other chlorinated solvent or a petroleum solvent. Although a single cleaning additive may be used, the method preferably uses a mixture of a dialkyl ketone, a carboxylic ester and a glycol ether. The textile is submersed in the non-polar solvent mixture and agitated over a specified amount of time to effect removal of resistant contaminants and insoluble and non-polar solvent soluble contaminants. The non-polar solvent and additives soften and dissolve the complex contaminants. To effect the removal of the resistant contaminants, the repellent material is partially or completely removed by the non-polar solvent and additives. It is preferable under most circumstances to filter the non-polar solvent during the cleaning step to prevent the redeposition of insoluble contaminants removed from the textiles and to permit the economical reuse of the non-polar solvent mixture. Under some circumstances, filtration may not be required depending on the nature of the contaminants and requirements under which the textiles are to be used. Should it be necessary to remove colored substances dissolved in the solvent, an adsorbent may be incorporated into the cleaning step. Further, it is also desirable to distill the solvent at regular intervals to remove soluble contaminants from the solvent, thereby enhancing the solvent's reusability.

To minimize contamination of the polar solvent and therefore any environmental impact, the textile preferably is dried prior to the washing step so as to remove residual non-polar solvents. The polar solvent used during the washing step preferably is water, while the washing additive is a surfactant or a blend of surfactants whose function is to provide the detergency needed to aid removal of insoluble contaminants.

The sacrificial repellent material is applied as necessary to maintain a predetermined amount of the repellent material on the textile in the range of from about 0.5 to about 3.0% solids on fabric by weight ("% SOF"), although the range of about 1.0 to about 2.5% SOF is preferred. This may be accomplished by applying the repellent material on the textile after a selected number of cycles of the cleaning step and the washing step have been performed on the textile, or after each cycle of the cleaning step and the washing step on the textile has been performed, if necessary. The textile is dried and may require curing during the drying process at specific temperatures for specific duration.

It is to be understood that both the foregoing general description and the following detailed description are exemplary and provided for purposes of explanation only, and are not restrictive of the invention, as claimed.

BRIEF DESCRIPTION OF THE DRAWINGS

The accompanying drawings, which are incorporated in and constitute a part of this specification, illustrate the preferred embodiment of the invention, and together with the description, serve to explain the principles of the invention.

DETAILED DESCRIPTION OF THE PREFERRED EMBODIMENT

Figure 1:
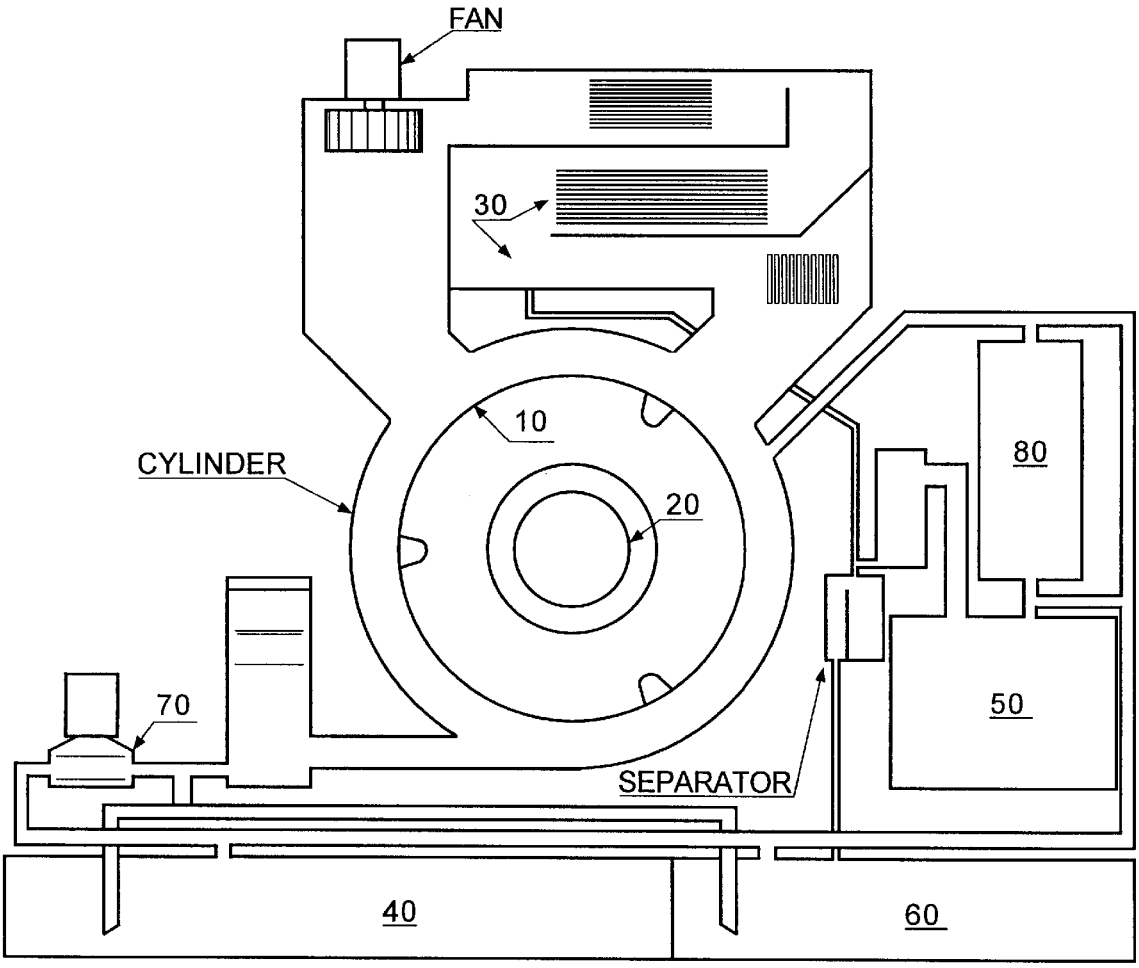
FIG. 1 is a schematic representation of a system used in the non-polar solvent cleaning step of the method of the present invention.

Reference will now be made in detail to a preferred embodiment of the method of the present invention. The system of the present invention will be described in conjunction with the detailed description of the method, an embodiment of which is illustrated in the accompanying drawings. Wherever possible, the same reference characters will be used throughout the drawings to refer to the same or like parts.

As used herein, the term "textile" broadly refers to and is inclusive of woven or nonwoven materials, as well as articles therefrom. Such textiles include, but are not limited to, fabrics, articles of clothing, protective covers, carpets, upholstery, furniture and window treatments. The term contamination as used herein broadly refers to and is inclusive of non-polar solvent soluble contaminants, polar solvent soluble contaminants, completely insoluble contaminants, and resistant contaminants as previously defined, as well as combinations thereof. Examples of such contaminants include, but are not limited to, perspiration, food, dirt, organic compounds, paint, ink, dye, chemical solutions and protective overcoating treatments.

For purpose of explanation and not limitation, reference will be made to "uniforms" or "garments" as exemplary textiles. Such uniforms or garments are often used in industrial environments, including environments where employees are subjected to exposure from overspray of coatings (either liquid or particulate) and chemical treatments. The uniforms therefore function to protect the conventional clothing of the employee. In addition to becoming contaminated with the liquid and particulate materials, the uniforms also often become soiled with perspiration, food stains and other organic compounds.

Prior to their initial uses and outside the scope of this invention, the uniforms may be commercially treated with a protective finish by the fabric manufacturer. Although this initial treatment may inhibit adhesion or penetration of the contaminants during the first few uses of the uniform, such commercial treatment generally has limited effectiveness after one or more cleanings.

Figure 3:
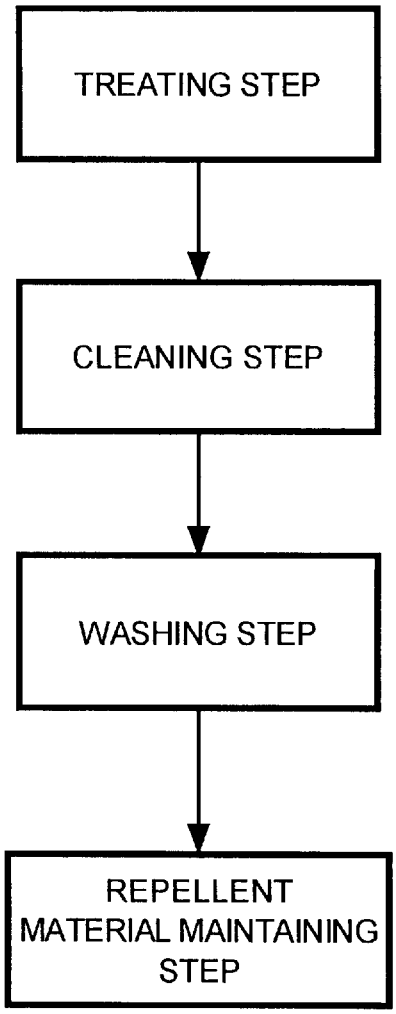
FIG. 3 is a flow diagram showing the various steps of the method of the present invention.

As shown in FIG. 3, and in accordance with the present invention, the method generally includes the steps of treating the textile with a non-durable sacrificial repellent material before placing the garment into service; cleaning the textile with a mixture of non-polar solvent and at least one cleaning additive to remove non-polar solvent soluble and insoluble contaminants and other resistant contaminants from the textile; and washing the textile with a polar solvent and at least one washing additive to remove polar solvent soluble contaminants from the textile. The non-polar solvent cleaning step preferably precedes the polar solvent washing step to prevent permanent setting of resistant contaminants. The method of the invention further includes a step of maintaining a predetermined amount of a sacrificial, repellent material on the textile. Further, the maintaining step includes textile drying that may also include curing of the repellent material. Each of these steps is described in detail separately below.

Non-Polar Solvent Cleaning Step

In the preferred embodiment of the invention, the method of the invention includes cleaning the contaminated textile in a mixture of non-polar solvent and at least one cleaning additive. The non-polar solvent mixture dissolves or softens the non-polar solvent soluble contaminants and certain resistant contaminants, such as coating and chemical treatment materials and the non-durable, sacrificial repellent material. The cleaning step also encompasses the removal of completely insoluble contaminants. In this manner, these contaminants can be removed more readily by agitation of the textiles.

A variety of non-polar solvents are known and available, particularly for use in conventional single solvent dry cleaning processes. The cleaning step therefore also may be referred to as a dry cleaning step. Such known non-polar solvents includes but are not limited to, PERC, or other chlorinated solvents, and petroleum solvents. PERC is often preferred due to proven effectiveness.

In accordance with the invention, the non-polar solvent is mixed with at least one or more cleaning additives. The cleaning additives preferably are selected based upon the resistant contaminants that need to be removed from the textile and other cleaning and process considerations.

For purpose of example and not limitation, a preferred composition of cleaning additives has been developed and tested for the removal of alkyd enamel paints from polyester fabric. This preferred composition includes a mixture of a dialkyl ketone, a carboxylic ester and a glycol ether. In a more preferred embodiment of the composition, the dialkyl ketone is methyl isobutyl ketone ("MIBK") ranging from about 2 to about 30 percent by weight, the carboxylic ester is butyl acetate ("BuAc") ranging from about 10 to about 60 percent by weight, and the glycol ether is ethylene glycol monobutyl ether; also known as 2-butoxyethanol ("2-BE"), ranging from about 10 to about 60 percent by weight. For convenience, this composition of cleaning additives is referred to hereinafter as "DK215-1." Preferably, the cleaning additive, such as DK215-1, is added to the non-polar solvent so as to constitute about 1 to about 5 percent by volume of the mixture.

In addition to the cleaning additives, one or more surfactant, anti-foaming agents or similar additives also may be mixed with the non-polar solvent to enhance the removal of contamination and to reduce foam formation. The surfactant additive is preferably about 0.25 to about 1.0 percent by volume of the non-polar solvent mixture. For example, one such agent sold under the trademark "BLENDSOL" is commercially available from R.R. Street & Co. Inc. of Naperville, Ill., for this purpose.

To perform the cleaning step of the present invention, a conventional dry cleaning system as shown schematically in FIG. 1 may be used, although it is recognized that alternative cleaning configurations may be used. The dry cleaning system generally includes a cylinder that encloses a rotating perforated basket or cage used for agitation 10, a textile loading door 20, a textile drying and solvent recovery section 30, a work solvent tank 40, a solvent distillation chamber 50, a distilled solvent tank 60, a solvent pump 70, and at least one filter 80, although other known dry cleaning system configurations are available which would meet the requirements of the process. These components are known and conventionally available in a variety of makes and models to satisfy a range of needs and required capacity.

In operation of the embodiment herein, the work solvent tank 40 and the distilled solvent tank 60 are filled with the non-polar solvent and charged with cleaning additives. The contaminated textiles are placed within the perforated agitation basket or cage 10, and the non-polar solvent mixture is pumped from the working solvent tank 40 into the agitation cage 10 to attain a solvent level sufficient to submerse the textiles in the non-polar solvent mixture. The agitation cage 10 is rotated to tumble the textiles in the non-polar solvent mixture for a predetermined period of time to perform one or more of the following: dissolve, soften and loosen non-polar solvent soluble contaminants; remove and suspend insoluble particulate contaminants; dissolve the non-durable, sacrificial repellent material; and remove the paints, coatings, and other resistant contaminants Using the solvent pump 70, the non-polar solvent mixture in the agitation cage 10 preferably is pumped to at least one filter 80 during the cleaning step to remove solvent insoluble contaminants from the non-polar solvent mixture. After passing through the filter 80, the filtered non-polar solvent mixture flows back to the agitation cage 10, to begin the circulation process over again. The closed loop circulation of the non-polar solvent mixture continues while the cleaning step is in progress so that insoluble contaminants are effectively removed from the non-polar solvent mixture to avoid potential redeposition of the insoluble contaminants onto the textiles.

Particularly, and although only one filter 80 is shown in FIG. 1, one or more filters of selected micron rating (15–30 microns) may be provided to remove insoluble contaminants from the non-polar solvent mixture. A polishing filter (0.5 to 5 microns) also may be provided for additional filtration. A filter unit including adsorptive material such as activated carbon also may be used to remove certain solvent soluble contaminants from the non-polar solvent mixture. Filter selection will be dependent on the requirements of the system, the textile to be cleaned, the solvent used and the needs of the user. In this manner, however, filtration allows the non-polar solvent mixture to be reused without recontamination of the textiles during subsequent cleaning operations.

In addition, by filtering the non-polar solvent and performing the cleaning step separately from the washing step, the non-polar solvent can be reused many times without affecting its cleaning performance of the textiles. The non-polar solvent also may be separated from the contaminants that have been removed from the textiles to minimize the volume of waste generated.

After the non-polar solvent cleaning step is completed; the non-polar solvent mixture is drained and extracted to the solvent distillation chamber 50, or may be drained and extracted to the work solvent tank 40. The drain and extract cycle is an intervening step to textile drying and non-polar solvent recovery. The extraction step mechanically removes as much of the liquid non-polar solvent mixture as possible from the textiles for recovery of the non-polar solvent and more efficient drying of the textile. The textiles are dried thoroughly to remove the remaining non-polar solvent mixture retained in the textile after extraction to recover the remaining non-polar solvent.

During the drying process, the non-polar solvent is vaporized, condensed and collected in the distilled solvent tank 60 in a conventional manner for reuse. Thorough drying also ensures that the textiles are free of the non-polar solvent so as to prevent transfer to the polar solvent used in the subsequent washing step, as will be described In addition, by preventing the non-polar solvent from entering the polar solvent mixture, environmental impact is minimized During the cleaning process, the non-polar solvent mixture dissolves solvent soluble contaminants, such as oils and greases. These contaminants will accumulate in the non-polar solvent mixture to an undesirable concentration. Undesirable amounts of solvent soluble contaminants left in the non-polar solvent mixture will have undesirable effects on the textiles cleaned under these conditions and potentially interfere with application of any subsequent protective treatment. To prevent the undesirable effects related to the excessive accumulation of solvent soluble contaminants, a portion or all of the contaminated nonpolar solvent mixture preferably is pumped to the distillation chamber 50 to be purified by a distillation process. The amount distilled is predicated on the amount of non-polar solvent soluble soils removed from the soiled textiles. The amount of non-polar solvent mixture removed from the working solvent system is replaced with purified non-polar solvent from the distilled solvent tank 60 and recharged with the appropriate cleaning additive(s)

In the distillation step, the non-polar solvent mixture and contaminants are heated sufficiently to vaporize the volatile non-polar solvent mixture. The solvent soluble soils and some of the cleaning additives, which are essentially non-volatile substances, remain behind as a still residue. The non-polar solvent vapor rises to a separate condensing chamber where the vapor is converted into purified liquid non-polar solvent. The condensed non-polar solvent is directed through a water separator to remove extraneous condensed water. The separated and distilled non-polar solvent is then directed to the distilled solvent tank 60 for subsequent reuse.

Polar Solvent Washing Step

As shown in FIG. 3, and in accordance with the invention, the method further includes the step of washing the textile with a mixture of polar solvent and at least one washing additive to remove polar solvent soluble contaminants from the textile. An exemplary polar solvent is water, which is preferred due to cost and availability. Common polar solvent soluble contaminants include perspiration, body odor, food and beverages, which generally result from normal wear or use of the textile.

To facilitate contaminant removal, the polar washing solvent further includes at least one washing additive. Such washing additives are well known, and often commercially available as a blend forming a detergent. For example, a surfactant or a blend of surfactants may be used. The washing additive preferably constitutes about 0.025 to about 0.05 percent by volume of the polar solvent. An example of such additive is detergent sold under the trademark "HYDROCARE", available from R.R. Street & Co. Inc.

Figure 2:
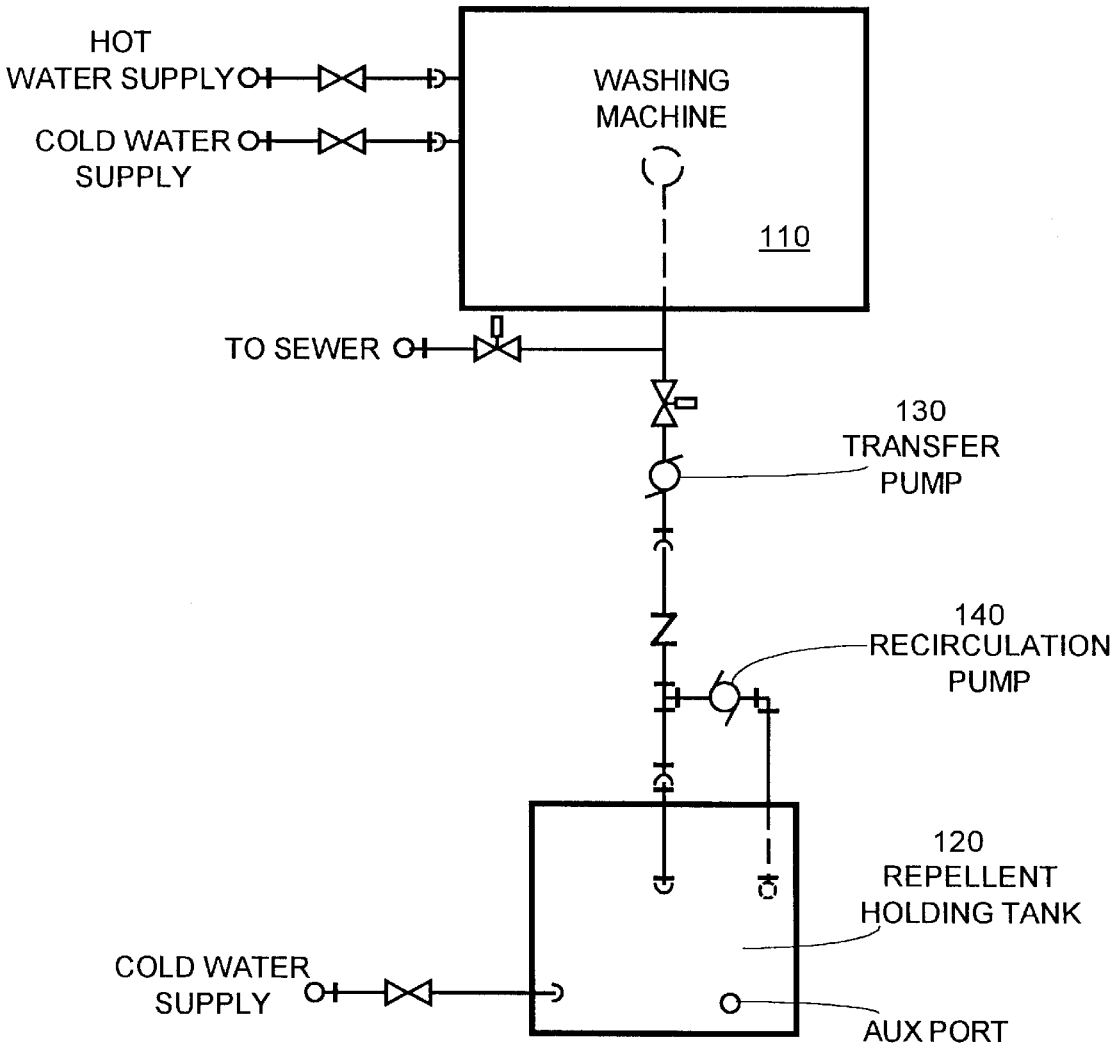
FIG. 2 is a plumbing schematic for a washing machine of the polar solvent washing step and the repellent tank of the repellent material maintaining step of the method of the present invention.

The washing step of the invention can be accomplished using a conventional commercial washing machine 110 as shown in FIG. 2. Preferably, one or more filters or other purification/conditioning methods may be provided to ensure the quality of the polar solvent used.

The textiles may or may not be dried between the washing step and the next step of the method, i.e., maintaining a predetermined amount of repellent material. If drying is desired, a modified industrial dryer is preferred so as to include microfiltration and precision temperature controls, though other methods may be used, depending on the requirements of the non-durable repellent material and textile. Particularly, the incoming air flow for the dryer preferably is filtered using a 0.5 to 5 micron rated air filter to prevent contamination of the textile while being processed in the dryer. A heated tumble dryer of suitable loading capacity can be modified to facilitate these parameters.

Repellent Material Maintaining Step

Repellent materials generally prevent the penetration of contaminants, such as coatings and other chemical treatments, into textiles; the removal of such contaminants therefore is further facilitated or enhanced by repellent materials. The method of the invention preferably includes the step of maintaining a predetermined amount of a non-durable, sacrificial repellent material before the garment is put in service and subsequent maintenance of the non-durable, sacrificial repellent material after the cleaning and washing steps.

Depending upon the repellent material used, the predetermined amount of repellent material is to be maintained on the textile to ensure desired characteristics. During the cleaning and washing steps of the method, however, repellent materials previously applied to the textile are diminished or substantially removed because the repellent material is partially soluble in the solvents used in the cleaning and washing steps. A predetermined amount of repellent material therefore may be maintained by applying the repellent material onto the textile after each cycle of performing the cleaning and washing steps, or by applying the repellent material after a selected number of cycles of the cleaning and washing steps have been performed Although other repellent materials are known, the method of the invention preferably uses either a fluorocarbon polymeric material, a hydrocarbon polymeric material, or a combination thereof. For example, although not by limitation, one such fluorocarbon polymeric material is WK275-2, which is commercially available from 3M Specialty Chemicals Division, of St. Paul, Minn., and which is also known as "FC-280." Another commercially preferred repellent material is WK086-1 from 3M Specialty Chemicals Division, of Antwerp, Belgium, which is also known as "TA-3912." When used on textiles that will be exposed to industrial painting processes, the use of WK086-1 is preferred because it reduces the risk of contamination of the surfaces to be painted or coated.

The step of maintaining a predetermined amount of repellent material is accomplished by submersing the textiles into a water bath containing the desired repellent solids. The concentration of repellent solids in the bath is dependent on the % wet pick-up "% WPU") of the textiles and the desired amount of repellent material to be deposited on the textile. The amount of repellent material required is typically in the range of from about 0.5 to about 3.0% solids on fabric by weight ("% SOF") and, more preferably, in the range of from about 1.0 to about 2.5% SOF.

As with the washing step, a conventional washing machine 110 may be used. In this manner, and as shown in FIG. 2, the washing machine 110 would be in fluid connection with a repellent holding tank 120 via a transfer pump 130. By introducing fresh water from a water supply and recirculating repellent material via a recirculation pump 140, the desired concentration and supply of repellent material can be provided to the washing machine 110. Optionally, a separate washing machine or similar device with a tank dedicated to the repellent material may be used.

Drying of the textiles in accordance with the method of the invention can be performed using an industrial tumble dryer. In addition to drying the textiles after the cleaning step, as well as after the washing step if desired, the textiles are dried after the step of maintaining the repellent material As previously noted, a dryer modified for microfiltration of incoming air may be used. Additionally, automatic or computer controls are preferred to further facilitate curing of the repellent material on the textile. For example, a preferred embodiment of the method includes increasing the temperature within the dryer at a rate of 2.5° C./min until 50° C. is reached, and then maintaining this temperature for approximately 5 minutes. The temperature is then raised at the rate of 2.5° C./min. to 100° C. and held for 15 minutes. To prevent distortion and wrinkling of the textile, the temperature is then reduced at the rate of 2.5° C./min. until ambient temperature is attained.

The Pilot Process

Reference now is made, for purposes of illustration and not limitation, to laboratory results obtained using a pilot process of the method of the invention. These laboratory results demonstrate that the method of the invention can significantly lengthen the useful life of garments, exemplified by service uniforms, which are used by automotive painters or others applying coatings in industrial settings while at the same time meeting cost requirements to make the method commercially viable Reference to the following laboratory results is intended for purpose of illustration and explanation, and not for purpose of limitation.

The parameters and operations specified below for the pilot process are identified from tests in which representative textile samples were used, also referred to herein as garments, however, these parameters and operations are provided for purpose of illustration and not limitation. The studies were done using the same fabric as that of uniforms worn by painters in the industrial paint industry and using the same types of coatings as used in the automotive paint industry. Thus, in the method of the present invention, it is anticipated that the pilot process comprises the steps of cleaning, washing and maintaining a predetermined amount of repellent material. In this illustrative embodiment of the invention, the non-polar solvent cleaning step is performed before the polar solvent washing step, though the method is not necessarily limited to this sequence of steps.

For each step of the method of the invention, important performance parameters have been identified. The results for various combinations of parameters were evaluated for stain removal efficacy. The details of the pilot process and several examples are described below.

Pilot Process Description

Non-Polar Solvent Cleaning Step

After wear and contamination, garments undergo a cleaning step, i.e., non-polar cleaning process, designed specifically to remove the paints, inks, dyes, and other coatings that are applied by painters and other industrial workers. Dry cleaning grade PERC, petroleum, or other appropriate non-polar solvents, together with cleaning additives selected for their demonstrated effectiveness on the particular contaminant and garment, are preferred for use in the method of the present invention. Sample garments cleaned with the method of the invention were tracked for the duration of the pilot study. After each complete treatment cycle, the garments were carefully inspected and their condition was documented.

In a preferred embodiment, the non-polar solvent cleaning step is accomplished using the equipment components shown in FIG. 1, and described above. A preferred dry cleaning additive used in the non-polar solvent cleaning step of the method is DK215-1. DK215-1, as described previously, was formulated for use in the pilot process. Tests indicate that the DK215-1 additive is particularly effective in the non-polar solvent cleaning process when removing industrial paints and coatings from polyester material, such as uniforms.

It is important that the non-polar solvent cleaning step remove substantial amounts of the non-polar and resistant contaminants, i.e., paints and coatings, from the garments being cleaned. Coatings and other such contaminants soluble in non-polar solvents should be removed to such a degree that the useful life of the garment is significantly extended without altering the comfort or appearance of the garment in any undesirable way. The following process parameters are monitored to achieve the desired level of performance:

1. Additive Concentration (i.e., DK215-1)=3.0% by vol.

While the preferred concentration of DK215-1 is 3.0% by volume, the cleaning additive generally can be added in an amount in the range of 1–5% by volume. This exemplary additive of the pilot process is miscible with non-polar solvents, but has different boiling characteristics. To ensure that the specified concentration is maintained in the PERC, or other nonpolar solvent, during the pilot process, the distillation and concentration of DK215-1 in the distilled solvent are monitored. It has been found, however, that distillation of the DK215-1 additive may be performed with no substantial losses or change in composition. Therefore, DK215-1 is added to the system only when new solvent is added to the machine. Although DK215-1 exhibits a flash point of 26° C. (as determined by the "Tag Closed Cup" method) the dissolved DK215-1 has no flashpoint at recommended use concentration.

2. Secondary Additive

Secondary additives can be used with the non-polar solvent mixture in accordance with the invention to further enhance removal of the contaminants and to prevent foaming of the solvent. For purpose of example, but not limitation, the secondary additive of the pilot process includes "BLENDSOL," although other industrial detergent blends may be used. "BLENDSOL" is preferred because it is non-substantive. The concentration of the additive is maintained by introducing the appropriate volume to the solvent whenever new or distilled solvent is used.

3. Waste water generation

The amount and condition of the waste water should not prohibit the normal processing of waste water effluent generated at the cleaning step. To ensure that this condition is met, the volume and condition of the waste water is monitored throughout the process. Testing of the pilot process produced negligible amounts of waste water.

4. Still condition

Regular distillation of solvent containing high concentrations of insoluble contaminants is required otherwise, the high concentration of insoluble contaminants could adversely affect the appearance of the garment and lead to difficulties in operation of the still. The condition of the still and the distillation rate are monitored throughout the process, and changes are made as needed to ensure proper operation of the still.

The non-polar solvent cleaning process of the invention used for the pilot process involves submersing, soaking or otherwise saturating the garments in the non-polar solvent mixture The work solvent tank 40 and distilled solvent tank 60 both are pre-charged with DK215-1 at 3.0% by volume. The work solvent tank 40 is also pre-charged with secondary additive at 0.5% by volume. The non-polar solvent cleaning step of the pilot process may include, but is not limited to, the following steps:

1. Bath 1

(1) Transfer 110 L (30 gal.) solvent from work solvent tank 40 to agitation cage 10.

(2) Agitate for 10–15 minutes.

(3) Drain for 1 min. to distillation chamber 50.

(4) Extract for 2 min. to distillation chamber 50.

2. Bath 2

(1) Transfer 110 L (30 gal.) solvent from distilled solvent tank 60 to agitation cage 10.

(2) Transfer 75 L (20 gal.) solvent from work solvent tank 40 to agitation cage 10.

(3) Dose solvent with "BLENDSOL" at 0.5% by vol. (550 ml)

(4) Circulate solvent mixture through filter for 15 minutes (for light and normal soiling) to 25 minutes (for heavy soiling).

(5) Drain for 1 min. to work solvent tank 40.

(6) Extract for 2 min. to work solvent tank 40.

The non-polar solvent used during the cleaning step should have a 0.5% by volume concentration of secondary additive at all times. Thus, 550 ml (19 oz.) of secondary additive is added to the agitation cage 10 per 110 L of distilled solvent. If desired, the following drying cycle is performed.

3. Dry Cycle (1) Tumble for 15 sec.

(2) Air only for 30 sec.

(3) Dry for 15–20 min. at 54° C. (130° F.).

(4) Cool down for 5–8 min.

Polar Solvent Washing Step

This step is intended to remove the polar solvent soluble contaminants, especially perspiration, which are not removed appreciably in the non-polar solvent cleaning step of the pilot process While the washing step does not necessarily contribute appreciably to the removal of the paints, coatings and other non-polar solvent soluble contaminants from the garments, it provides an important step in the complete maintenance of the textiles As with the non-polar solvent of the cleaning step, at least one washing additive is mixed with the polar solvent of the washing step. Generally, such washing additives are mixed with the polar solvent so as to result in a concentration of about 0.025% to about 0.050% by volume. For example, the washing additive of the pilot process is the detergent sold under the trademark "HYDROCARE". A preferred "HYDROCARE" concentration of 0.025% by volume is maintained to achieve desired performance.

As depicted in FIG. 2, and noted above, the polar solvent washing step of the pilot process uses the following components: washing machine 110, repellent tank 120, transfer pump 130, and recirculation pump 140. The garments being cleaned may or may not be dried prior to the repellent material maintaining step so it is efficient and economical to connect the equipment for these steps.

An example of the polar solvent washing step includes but is not limited to:

1. Wash Cycle (1) 225 L (60 gal.) water at 43°–49° C.

(2) Dose with "HYDROCARE" at 0.25 g/L=50 ml (3) Run for 5 minutes.

(4) Drain for 1 min. to sewer.

(5) Extract for 3 min. to sewer.

2. Rinse Cycle (Two Times)

(1) 150 L (40 gal.) water at 21° C.

(2) Run for 3 minutes.

(3) Drain for 1 min. to sewer.

(4) Extract for 3 min. to sewer.

3. Drying cycle

While the garments may be dried prior to application of the repellent material, in a preferred embodiment, no drying cycle is used between the polar solvent wet washing step and the repellent material maintaining step.

Maintaining Repellent Material Step

The repellent material applied to the garments of the pilot process is soluble or partially soluble in the mixture of the non-polar cleaning solvent and DK215-1. While it is possible for some repellent to remain on the textile after cleaning, the repellent material selected for the process is substantially removed in the prior steps of the method. Consequently, it may be necessary to reapply the repellent material so that a predetermined amount of repellent material remains on the garment after the method of the invention is completed and so that complex contaminant removal is facilitated in future processing. To maintain a desired or predetermined amount of the repellent material on the garment, repellent material may be applied each time the method of the invention is performed, or after a selected number of cycles of the method, depending on the solubility of the non-durable sacrificial repellent material and the amount applied to the textile.

The preferred repellent material of the pilot process is WK086-1. The concentration is determined to yield 1.0% solids add-on based on the dry weight of the fabric. While repellent material can be added to yield an amount of 1–3% solids based on the dry weight of the fabric, the amount is limited by the effects of wearability. WK086-1 concentration is monitored to achieve the desired performance characteristics of oil repellency and water repellency.

1. Oil Repellency

Treated garments should exhibit an oil repellency rating as determined by the 3M Oil Repellency Test method sufficient for the intended use.

2. Water Repellency

Treated garments should exhibit a water repellency rating as determined by the 3M water repellency test method sufficient for the intended use. The repellent material maintaining step may include the following steps:

1. Garments are placed in washing machine 110.

(1) Transfer 113 L (30 gal.) of repellent material from repellent tank 120 to the washing machine 110.

(2) Tumble garments for 3 minutes.

(3) Drain for 1 min. to repellent tank 120.

(4) Extract for 2 min. to repellent tank 120.

2. Garments are transferred to the dryer.

(1) Increase temperature from ambient to 50° C. at a rate of 2.5° C./min.

(2) Dry at 50° C. for 8 min.

(3) Increase temperature to 100° C. at a rate of 2.5° C./min.

(4) Cure at 100° C. for 15 min.

(5) Decrease temperature to ambient at a rate of 2.5° C./min.

The parameters for the cure cycle, indicated by numbers 1, 2, 3, 4, and 5 above, are dependent on the specific repellent being used and, therefore, should be adjusted to meet the specifications of the manufacturer.

Process Evaluation

The pilot process is evaluated for performance as determined by stain removal ability including the number of stains per garment as a function of the number of cleanings, DK215-1 concentration, and repellent add-on. The physical characteristics of stains remaining on garments after the pilot process non-polar solvent cleaning step are evaluated for color, size and integrity. The successful removal of paints, inks and other coatings is balanced against the function, appearance and comfort of the garments after treatment. Important characteristics related to appearance are drape and hand, discoloration, and odor. Important characteristics related to function and comfort include dimensional stability or fit, breathability and impermeability of the textile to the paints. The garments cleaned by the pilot process are also evaluated for particulate contamination using a Helmke drum apparatus, which is well known in the field. The results achieved by the pilot process of the invention with respect to appearance, comfort and particulate contamination are superior to the results achieved with conventional techniques.

EXAMPLES

Reference is now made to representative examples to demonstrate various aspects and results of the steps of the invention. These examples are provided for purpose of explanation and description, and not limitation.

Example 1

A process for cleaning uniforms stained with alkyd enamel from PPG Industries was evaluated. The garments were 100% polyester.

Test 1

The purpose was to identify the most effective additives for paint removal in a non-polar solvent. Fabric samples that were stained with paint were cut into swatches of approximately 10×12 cm. The following additives in 150 ml PERC were evaluated in a Launder-O-Meter, commercially available from Atlas, Chicago, Ill., for 0.5 hour. Both of the additives, sold under the trademarks "FABRICOL" and "BLENDSOL," are commercially available from R.R. Street & Co. Inc. Six different test runs were conducted with different additive combinations as indicated below.

| | |
|---|---|
| Run 1. | 0.5% (vol.) "FABRICOL" |
| Run 2. | 0.5% "FABRICOL" and 3.2% DK215-1 |
| Run 3. | 3.2% DK215-1 |
| Run 4. | PERC only |
| Run 5. | 0.5% "BLENDSOL" |
| Run 6. | 0.5% "BLENDSOL" and 3.2% DK215-1 |

Runs 2 and 6 exhibit the best paint removal from the soiled fabric samples.

Test 2

The purpose of this test was to demonstrate the positive effect of a non-durable, sacrificial repellent material on paint removal. Fabric from the same source used for Test 1 was treated with FC-280 (3M) repellent material at 2.9% SOF.

After treatment, the swatches were pressed with an iron using the synthetic setting. The swatches were stained, in separate areas with the following paints: glacier white, dark blue base coat, grey primer and clear coat. The paint was allowed to dry for two days at room temperature and 0.5 hour at 120° F. "BLENDSOL" and DK215-1 was the most effective combination for removal of the paint. Pretreating the swatches with the FC-280 repellent aided in the removal of blue base coat and grey primer to a great extent. The repellent had a lesser effect on the glacier white paint which was almost completely removed from untreated swatches and completely removed from treated ones. Clear coat was completely removed from both untreated and treated swatches.

Example 2

Initial laboratory tests indicated that a combination of additives in the polar solvent and fabric retreatment with a non-durable, sacrificial repellent material provided satisfactory results.

Test 3

The purpose was to identify the most effective conditions for achieving optimal paint removal. The results are identified below.

Experimental Conditions

Used work uniforms were cut into swatches These swatches were pre-cleaned in a Launder-O-Meter to remove as much paint as possible before preparing stained swatches. After cleaning, some of the swatches were treated with a non-durable, sacrificial repellent material. The repellent material is an aqueous emulsion which was applied in a dip-bath. Treated swatches were allowed to air dry at room temperature, then cured at 70° C. for 30 minutes. Treated and untreated swatches were then stained with paints supplied by PPG Industries and allowed to air dry for a minimum of two days. The paints were identified as follows:

Lagoon blue basecoat

Glacier White

Clearcoat

Grey Primer

All cleaning tests were conducted in PERC solvent in the Launder-O-Meter.

More particularly, 10×10 cm swatches for runs 1 through 7 were cut out from used work uniforms. Swatches were cleaned in 0.5% "BLENDSOL" and 3.2% DK215-1 to remove as much paint as possible before treating with FC-280. Cleaning was done in a Launder-O-Meter, 5 swatches per container. Half the swatches were treated with FC-280 at 3% SOF. Treated swatches were cured for 30 min. at 160° F. in an oven. All swatches, treated and untreated, were then stained with each of the four paints from PPG Industries. Stained swatches were allowed to dry, then cleaned in a Launder-O-Meter, as described below.

The swatches for runs 8 through 11 were prepared the same as for runs 1 through 7 except that two different amounts of FC-280 were used and a different load factor and liquor ratio were used. Ten swatches were washed in 100 ml PERC baths for runs 8 and 10, 5 swatches in 100 ml PERC baths for runs 9 and 11.

Table 1 summarizes the experimental conditions for each run. The loading factor for runs 1 through 11 ranged from 1 kg: 47 L to 1 kg: 164 L. The liquor ratios ranged from 1 kg: 8 L to 1 kg: 43 L. Stained swatches were aged from 2 to 10 days at room temperature before cleaning. The paint removal results are summarized in Table 2 below.

TABLE 1

EXPERIMENTAL CONDITIONS

| RUN # | % SOF | BATH #1 | BATH #2 |
|---|---|---|---|
| 1 | 3 | Perchloroethylene only | None |
| 2 | 3 | Perchloroethylene only | 0.5% Perchloroethylene only |
| 3 | 3 | BATH #2 from RUN #2 | 0.5% BLENDSOL in Perchloroethylene |
| 4 | 3 | Perchloroethylene only | 0.5% BLENDSOL & 1.6% DK215-1 in perchloroethylene |
| 5 | 3 | Perchloroethylene only | 0.5% BLENDSOL & 3.2% DK215-1 in perchloroethylene |
| 6 | 3 | BATH #2 from RUN #4 | 0.5% BLENDSOL & 1.6% DK215-1 in perchloroethylene |
| 7 | 3 | BATH #2 from RUN #5 | 0.5% BLENDSOL & 3.2% DK215-1 in perchloroethylene |
| 8 | 2.4 | 0.5% BLENDSOL & 1.6% DK215-1 in Perchloroethylene | 0.5% BLENDSOL & 1.6% DK215-1 in perchloroethylene |
| 9 | 2.4 | BATH #2 from RUN #8 | 0.5% BLENDSOL & 1.6% DK215-1 in perchloroethylene |
| 10 | 1.1 | 0.5% BLENDSOL & 1.6% DK215-1 in Perchloroethylene | 0.5% BLENDSOL & 1.6% DK215-1 in perchloroethylene |
| 11 | 1.1 | BATH #2 from RUN #10 | 0.5% BLENDSOL & 1.6% DK215-1 in perchloroethylene |

Example 3

Figure 4:
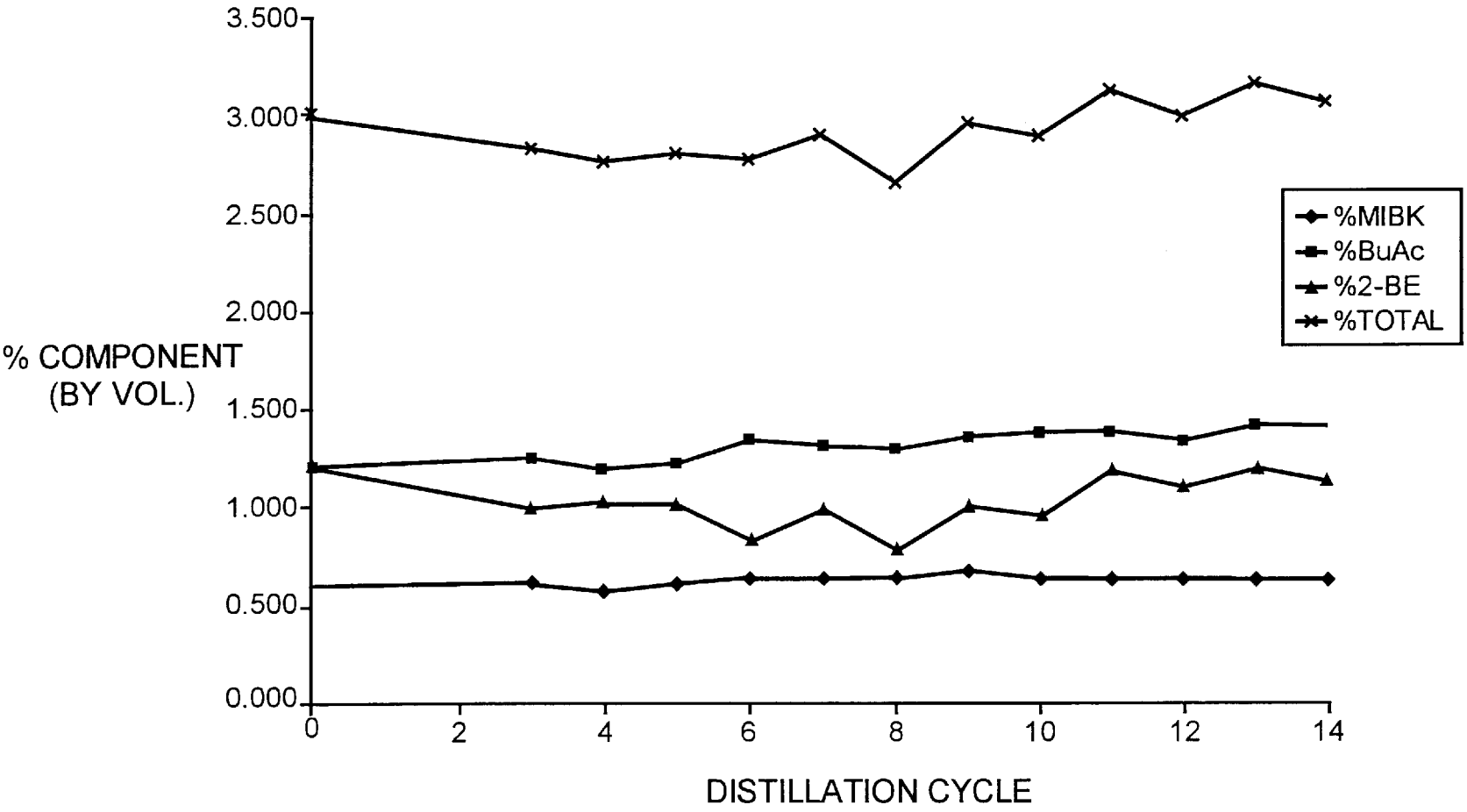
FIG. 4 is a plot of cleaning additive concentration versus the number of cleaning solvent distillation cycles.

The purpose of this test was to determine the constant composition of DK215-1 after repeated distillation cycles under commercial conditions of the non-polar solvent step. Samples were taken after each distillation cycle and analyzed by gas chromatography. FIG. 4 shows a plot of the concentration of the total mixture of DK215-1 and its individual components versus the number of distillation cycles. The results show that the concentration of DK215-1 and its components remain constant over repeated distillation of the non-polar solvent mixture.

Example 4

The purpose of the experiment was to test the feasibility of a turbidimetric method for analyzing FC-280 concentration.

Figure 5:
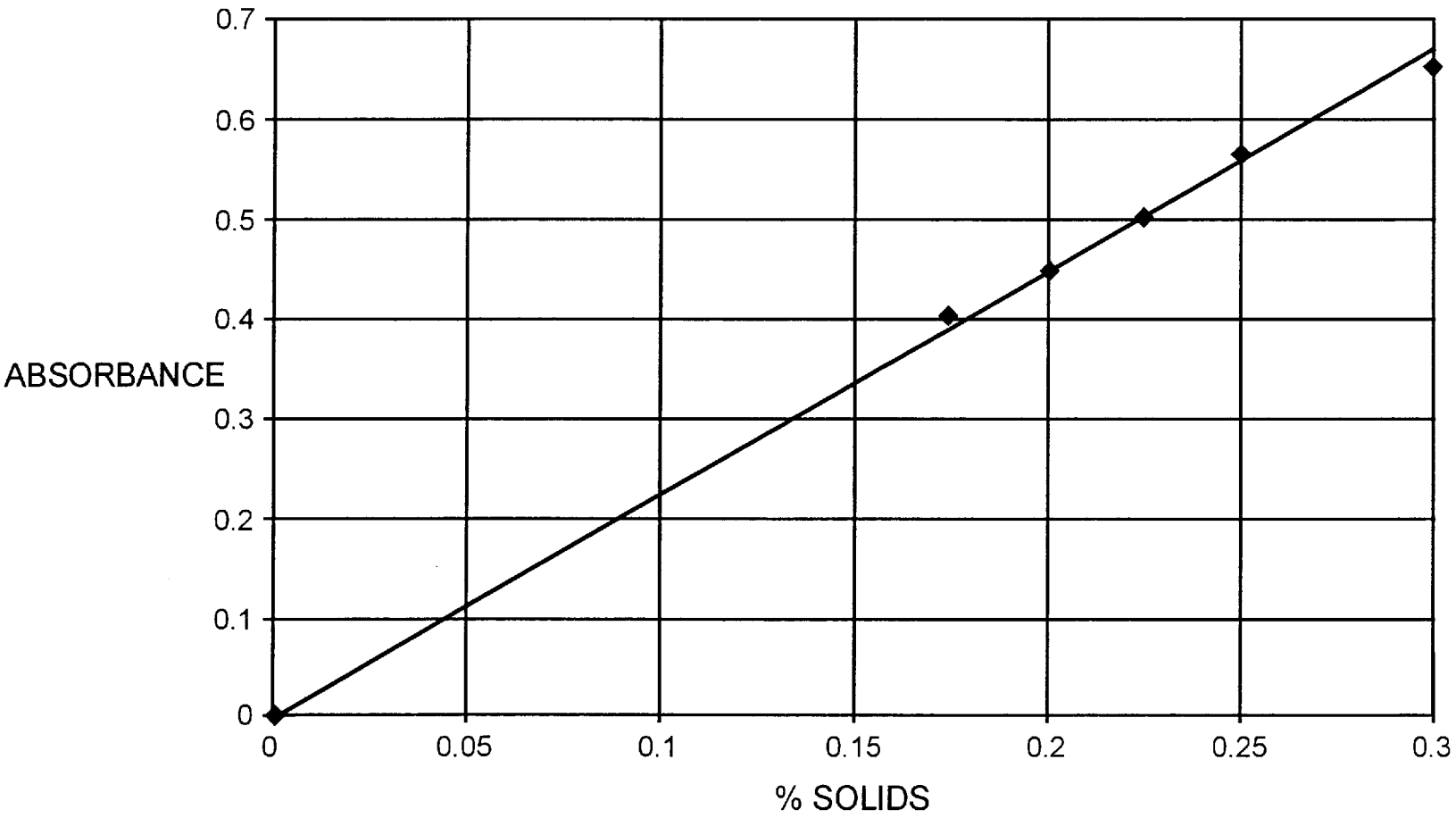
FIG. 5 is a plot of absorbance, as a measurement of turbidity, versus concentration of repellent material for purposes of maintaining a predetermined amount of repellent material on the textile.

A 5% solids solution (suspension) of FC-280 (35% solids) in water was prepared. Various sized aliquots were further diluted to 100 mL with water. The absorbance of the aliquots was measured with a standard UV-visible calorimeter at 420 nm and path length of 19 mm. The results shown in FIG. 5 illustrate that the turbidity, as measured by absorbance, of the repellent material solution is linearally related to the concentration of repellent material in the range tested. Therefore, turbidity can be used to monitor and maintain the amount of repellent material in the practice of the method of the invention.

TABLE 2

AMOUNT OF PAINT REMOVED

| | LAGOON BLUE | | GLACIER WHITE | | CLEARCOAT | | GREY PRIMER | |
|---|---|---|---|---|---|---|---|---|
| RUN # | UNTREATED SWATCHES | TREATED SWATCHES | UNTREATED SWATCHES | TREATED SWATCHES | UNTREATED SWATCHES | TREATED SWATCHES | UNTREATED SWATCHES | TREATED SWATCHES |
| 1 | None | None | Partial | Substantial | Complete | Complete | None | Partial |
| 2 | None | Slight | Partial | Complete | Complete | Complete | None | Substantial |
| 3 | Very slight | Slight | Partial | Complete | Complete | Complete | None | Nearly Complete |
| 4 | None | Partial | Partial | Complete | Complete | Complete | None | Nearly Complete |
| 5 | None | Partial | Partial | Complete | Complete | Complete | None | Nearly Complete |
| 6 | None | Partial | Partial | Complete | Complete | Complete | None | Nearly Complete |
| 7 | None | Nearly Complete | Partial | Complete | Complete | Complete | None | Complete |
| 8 | — | Partial | — | Complete | — | Complete | — | Nearly Complete |
| 9 | — | Partial | — | Complete | — | Complete | — | Complete |
| 10 | — | Partial | — | Complete | — | Complete | — | Nearly Complete |
| 11 | — | Partial | — | Complete | — | Complete | — | Complete |

Conclusions:

These tests demonstrated that retreatment of the work uniforms with a non-durable sacrifial repellent material produces satisfactory removal of paint from subsequently non-polar solvent cleaned garments. In addition to the effect of retreatment, the non-polar solvent cleaning step exhibits unique paint removal properties such that it removed paint to a satisfactory extent. The level of retreatment required is in the range of from about 0.5 to about 3.0% SOF and, more preferably, in the range of from about 1.0 to about 2.5% SOF. The concentration of DK215-1 required is in the range of about 1% to about 5% by volume and, more preferably, 3%. The concentration of "BLENDSOL" required is in the range of about 0.25% to about 1.0% by volume and, more preferably 0.5% by volume.

PILOT PROCESS FOR CLEANING PAINTER'S COVERALLS

Results of First Commercial Scale Test

To demonstrate the efficacy of the process on a commercial scale, two separate pilot processes were evaluated using different non-durable, sacrificial repellent materials. The garments used for testing were made of 100% polyester fabric which was selected for its comfort, anti-static and non-linting properties - all of which are desirable in the automotive painting industry.

In the first pilot study, garments were treated with WK275-2, a fluorocarbon polymeric material used as the non-durable, sacrificial repellent material following the cleaning procedures outlined earlier. After treatment, the garments were worn during an eight-hour shift in the paint shop of an automotive manufacturer. The contaminated garments were returned to the processing site for cleaning and treatment. The wearing/processing cycle was repeated twice. Each time the garments were carefully inspected and their condition recorded before and after processing. The results are included in Tables 3 and 4. Note that for the second wearing, only seven of the original ten painters were available

TABLE 3

Results of First Complete Treatment/Wear Cycle using WK275-2 (0.7% SOF)

| Garment | Condition Before Processing | Condition After Processing |
|---|---|---|
| 1 | Mostly blue paint with some red dripped down the front. Blotches of red on left cuff and under left arm. | All paint has been removed except for slight trace of red paint on cuff and underarm. |
| 2 | Covered extensively with blue paint over front. Also red blotches where paint has penetrated fabric. | Paint which has bled through is completely removed. Just a trace of blue paint is visible. |
| 3 | Garment is lightly soiled with blue paint. Two blotches of blue paint on right hip. | Paint has been completely removed. |
| 4 | Predominantly blue paint on garment with red splotches down front and on right cuff. Red overspray over front. | A trace of red is visible on breast pocket and ID patch. |
| 5 | Blue paint and dark stains on front and sleeves. Particularly dark area on left hand side waist level and on around ankles. Paint has bled through almost the entire front. Dark spots have bled through on inside of waist and ankles. | All paint has been removed except for a dark area on waist. |
| 6 | Blue overspray over entire garment with red splotches down front. Heavy s of blue and red paint in mid-section. Blue splotches on right leg. Blue/red paint on back of garment below the waist. Blue and red paints have bled through on front and back of legs. | No traces of paint inside garment. A trace of paint on mid section. |
| 7 | Light metal flake overspray over front. Blue has bled through at one point. | Overspray completely removed. No trace of paint had bled through garment. |
| 8 | Light blue/black overspray over entire front. Red and blue paint has bled through. | Faint blue area visible near left pocket. |
| 9 | Red overspray over entire front. Red splotches at waist in front and left breast area. | Very faint trace of red on waist area. |
| 10 | Blue or black overspray and drips on front and right paint cuff. | Blue and black paint has been completely removed. |

TABLE 4

Results of Second Complete Treatment/Wear Cycle using WK275-2 (0.7% SOF)

| Garment | Condition Before Processing | Condition After Processing |
|---|---|---|
| 1 | Blue overspray and splotches over front. Red splotches on front at waist. Blue paint bled through on left side and on back of legs. Red overspray on sleeves. | No traces of paint visible. |

TABLE 4-continued

Results of Second Complete Treatment/Wear Cycle using WK275-2 (0.7% SOF)

| Garment | Condition Before Processing | Condition After Processing |
|---|---|---|
| 2 | Very light soiling with dark green splotches on right side of front. Right sleeve has red splotches. | No traces of paint visible. |
| 3 | Sparse green and blue splotches on front. Right sleeve has blue overspray and splotches. Green paint on back of left leg. | No traces of paint visible. |
| 4 | Blue and red overspray and splotches on front. Red overspray on right sleeve. White and red on right sleeve. Red and white on right leg. Paint bled slightly at crotch area. | No traces of paint visible. |
| 5 | Left leg covered heavily with blue paint. Splotches of red and blue are on right leg. Some bleed through on front of right leg. | No traces of paint visible. |
| 6 | Red paint over entire front. Paint bled through where splotches were. | Very slight trace of red on left front waist area. |
| 7 | Blue has bled through front of both legs. | No traces of paint visible. |

Results of Second Commercial Scale Test

In the second pilot test, three garments made from the same 100% polyester fabric were treated with WK086-1, a hydrocarbon polymeric material used as the non-durable, sacrificial repellent material following the procedure outlined earlier. After the application and curing of the repellent material, each garment was soiled with a red alkyd enamel from PPG Industries by spraying, using a Bosch Model PSP 260 airless paint sprayer After allowing the paint to cure at ambient temperature for at least twelve hours, the garments were processed and examined. This process was repeated for several cycles and the condition of the garment recorded. The results are summarized in Table 5.

TABLE 5

Results of the Second Pilot Test Using WK086-1

| Soiling/Processing Cycle | % SOF | Garment | Condition After Processing |
|---|---|---|---|
| 1st | 0.6 | A | No trace of red paint. |
| | 0.7 | B | No trace of red paint. |
| | 1.1 | C | No trace of red paint. |
| 2nd | | A | No trace of red paint. |
| | 0.7 | B | No trace of red paint. |
| | | C | No trace of red paint. |

Based upon the foregoing, the present invention provides an effective method for removing contaminants, particularly for removing complex combinations of contaminants, from textiles. In this manner, the method of the invention allows a variety of both non-polar and polar solvent soluble contaminants and resistant contaminants to be removed effectively; prevents undesirable commingling of dissimilar solvents; reconditions the textiles with softening and size controlling chemicals to return desirable characteristics removed by the solvents; maintains a desired amount of repellent material on the textile to minimize contamination;

and prevents the residual presence of contaminants that would interfere with the industrial process in which the textile is involved.

It will be apparent to those skilled in the art that various modifications and variations can be made in the method of the present invention without departing from the spirit or scope of the invention. Thus, it is intended that the present invention covers modifications and variations that come within the scope of the appended claims and their equivalents.

What is claimed:

1. A method for removing paints, undercoatings, and sealants from a textile contaminated therewith, the method comprising the steps of:

cleaning the textile with a mixture of a non-polar solvent and at least one cleaning additive to remove non-polar solvent soluble contaminants from the textile;

washing the textile with a mixture of a polar solvent and at least one washing additive to remove polar solvent soluble contaminants from the textile; and maintaining an amount of a repellent material on the textile.

2. The method of claim 1, wherein the cleaning step includes treating the textile in the mixture of the non-polar solvent and the at least one cleaning additive.

3. The method of claim 2, wherein the cleaning step further includes agitating the textile within the mixture of the non-polar solvent and the at least one cleaning additive.

4. The method of claim 1, wherein the non-polar solvent of the cleaning step is selected from chlorinated solvent and petroleum solvent.

5. The method of claim 1, wherein the at least one cleaning additive mixed with the non-polar solvent is selected from a dialkyl ketone, a carboxylic ester and a glycol ether.

6. The method of claim 5, wherein the at least one cleaning additive mixed with the non-polar solvent is a mixture of a dialkyl ketone, a carboxylic ester and a glycol ether.

7. The method of claim 6, wherein the dialkyl ketone is methyl isobutyl ketone ranging from about 2 to about 30 percent by weight, the carboxylic ester is butyl acetate ranging from about 10 to about 60 percent by weight, and the glycol ether is ethylene glycol monobutyl ether ranging from about 10 to about 60 percent by weight.

8. The method of claim 1, wherein the mixture of the non-polar solvent and the at least one cleaning additive further includes at least one surfactant.

9. The method of claim 1 further including the step of filtering the non-polar solvent during the cleaning step for reuse of the non-polar solvent and removal of solid contaminants from the textile and the non-polar solvent.

10. The method of claim 1 further including the step of distilling the non-polar solvent during or after the cleaning step for reuse of the non-polar solvent and removal of soluble contaminants from the textile and the nonpolar solvent.

11. The method of claim 1 further including the steps of drying the textile and recovering the non-polar solvent after the cleaning step.

12. The method of claim 1, wherein the polar solvent of the washing step is water.

13. The method of claim 1, wherein the at least one washing additive mixed with the polar solvent is a blend of surfactants.

14. The method of claim 1, wherein the repellent material of the maintaining step is a fluorocarbon polymeric material.

15. The method of claim 1, wherein the repellent material of the maintaining step is a hydrocarbon polymeric material.

16. The method of claim 1, wherein the amount of the repellent material maintained on the textile is in the range of from about 0.5 to about 3.0% solids on fabric by weight.

17. The method of claim 1, wherein the step of maintaining the amount of the repellent material on the textile is performed by applying the repellent material on the textile after a number of cycles of the cleaning step and the washing step have been performed on the textile.

18. The method of claim 1, wherein the step of maintaining the amount of the repellent material on the textile is performed by applying the repellent material on the textile after each cycle of performing the cleaning step and the washing step on the textile.

19. The method of claim 1 further including the step of drying the textile after the step of maintaining the amount of the repellent material on the textile so as to dry the textile and repellent material, and when necessary to cure the repellent material on the textile.

* * * * *